US007565857B2

(12) United States Patent
Johnson

(10) Patent No.: US 7,565,857 B2
(45) Date of Patent: Jul. 28, 2009

(54) METHOD OF CHARGING A CONTAINER WITH AN ENERGETIC MATERIAL

(76) Inventor: Richard John Johnson, 5/19 McDonald Street, Kalgoorlie W.A. 6430 (AU)

( * ) Notice: Subject to any disclaimer, the term of this patent is extended or adjusted under 35 U.S.C. 154(b) by 0 days.

(21) Appl. No.: 11/547,620

(22) PCT Filed: Apr. 8, 2005

(86) PCT No.: PCT/AU2005/000519

§ 371 (c)(1),
(2), (4) Date: Oct. 5, 2006

(87) PCT Pub. No.: WO2005/097597

PCT Pub. Date: Oct. 20, 2005

(65) Prior Publication Data

US 2007/0184219 A1 Aug. 9, 2007

(30) Foreign Application Priority Data

Apr. 8, 2004 (AU) ..... 2004901869

(51) Int. Cl.
*F42B 4/00* (2006.01)

(52) U.S. Cl. ..... 86/20.1; 86/20.13; 103/325

(58) Field of Classification Search ..... 86/20.1, 86/20.13; 102/325–330
See application file for complete search history.

(56) References Cited

U.S. PATENT DOCUMENTS 1,149,844 A 8/1915 Lieber
2,360,198 A 10/1944 Carter
2,613,864 A 10/1952 Carter
3,702,147 A * 11/1972 Slawinski ..... 141/12
3,783,735 A * 1/1974 Murphy et al. ..... 86/20.12
4,004,398 A 1/1977 Larsson et al.
4,090,342 A * 5/1978 Rishel ..... 53/435
4,133,281 A 1/1979 Holmes et al.
4,149,576 A * 4/1979 Vinson et al. ..... 141/392
4,562,691 A * 1/1986 Rapparini ..... 53/552
4,628,971 A 12/1986 Belot
4,640,322 A 2/1987 Ballester
4,922,650 A * 5/1990 Akao et al. ..... 47/1.1
5,062,343 A 11/1991 Sjöberg
5,331,789 A * 7/1994 Cur et al. ..... 53/434

(Continued)

FOREIGN PATENT DOCUMENTS

AU 9918611 A * 8/1999

(Continued)

*Primary Examiner*—Bret Hayes
*Assistant Examiner*—Michael D David
(74) *Attorney, Agent, or Firm*—Weingarten, Schurgin, Gagnebin & Lebovici LLP

(57) ABSTRACT

The present invention provides a method of charging at least one container, such as a tube, with an energetic material. The method comprises the step of reducing a pressure of a fluid in an interior portion of the or each container. The method also comprises the step of positioning the energetic material at a position that is exterior to the or each container and at which a pressure is higher than in the interior portion of the or each container in a manner such that a suction results which sucks the energetic material into the interior portion of the or each container and thereby charges the or each container with the energetic material.

24 Claims, 2 Drawing Sheets

U.S. PATENT DOCUMENTS 5,473,866 A * 12/1995 Maglecic et al. ..... 53/511
5,532,011 A * 7/1996 Goglio ..... 426/316
5,678,387 A * 10/1997 Aarts ..... 53/434
5,970,687 A * 10/1999 Katayama et al. ..... 53/451
6,513,308 B1 * 2/2003 Meeuwesen et al. ..... 53/551
2005/0150781 A1 * 7/2005 Barton et al. ..... 206/3

FOREIGN PATENT DOCUMENTS

DE 3242746 A1 * 5/1984

* cited by examiner

METHOD OF CHARGING A CONTAINER WITH AN ENERGETIC MATERIAL

This application is a § 371 national phase filing of PCT/AU2005/000519 filed Apr. 8, 2005, and claims priority to Australian application No. 2004 901869 filed Apr. 8, 2004.

FIELD OF THE INVENTION

The present invention broadly relates to a method of charging at least one container with an energetic material. The present invention relates particularly, though not exclusively, to a method of filling a plurality of tubes with the energetic material.

BACKGROUND OF THE INVENTION

In the mining and civil construction industries hard materials such as rock and concrete are fractured and/or removed using explosives and propellants hereafter referred to in general as "energetic materials". Typically blast holes are drilled in the hard material and filled with the energetic material which is subsequently detonated. The energetic materials may be provided in form of granules, a powder or a liquid that typically are filled directly into the blast holes.

Alternatively, tubes in which the energetic materials are packaged and sealed are used. Such tubes typically are composed of a plastics material and offer more flexibility. For example, they can be positioned within a blast hole or at any other position at which an explosion is required. The tubes can be charged with the energetic material by pressing the energetic material into the tubes in a variety of known ways including blow loading, augering or gravity feed.

The process of charging the tubes with the energetic materials is not without danger. Mechanical friction caused by tools used for charging the tubes may result in development of heat which could detonate the energetic materials. Further, contact of tools with each other could result in sparking which has the same danger. In addition, the charging techniques known to date have the disadvantage that it is relatively difficult to remove air from the interior of the tubes during the charging process and consequently it is relatively difficult to charge the tubes so that the energetic materials are densely packed within the tubes.

There is a need for technological advancement.

SUMMARY OF THE INVENTION

The present invention provides in a first aspect a method of charging at least one container with an energetic material, the method comprising:

reducing a pressure of a fluid in an interior portion of the or each container, positioning the energetic material at a position that is exterior to the or each container and at which a pressure is higher than in the interior portion of the or each container in a manner such that a suction results which sucks the energetic material into the interior portion of the or each container and thereby charges the or each container with the energetic material.

As the reduced pressure in the interior portion of the or each container causes charging of the or each container with the energetic material, moveable parts which could cause friction and thereby development of heat can largely be avoided and consequently the above-defined method provides improved safety. Further, as the reduction of the pressure in the interior portion of the or each container typically involves removal of at least a portion of the fluid, which typically is air, dense packing of the each container with the energetic material is facilitated.

The step of reducing the pressure in an interior portion of the or each container typically comprises reducing the pressure in the entire interior of the or each container.

Charging of the or each container may be supported by gravity and/or by vibrating the or each container which may further increase the packing density of the energetic material in the container.

The method typically comprises filling the or each container with the energetic material.

The step of reducing the pressure in the interior portion of the or each container typically comprises evacuating the interior portion of the or each container.

In one specific embodiment of the present invention the step of reducing the pressure in the interior portion of the or each container comprises removing at least a portion of the fluid from an interior portion of a receptacle in which the or each container is positioned. For example, the or each container may be a tube and more than ten or more than one hundred tubes may be positioned in the receptacle which may be evacuated by evacuating the receptacle.

The method may also comprise the step of opening the receptacle after it has been evacuated, for example by opening a shutter, so as to allow the energetic material to be sucked into the interior portion of the or each container positioned in the receptacle. The method typically also comprise guiding the energetic material into an opening of the or each container using a guiding portion positioned adjacent the opening of the or each container.

The energetic material may be a liquid energetic material, such as an emulsion or a water gel, or may be a flowable solid energetic material such as a powder, granules or aluminium nitrate prills.

The step of positioning the material may be followed by increasing a pressure in a volume in which the energetic material is positioned. This would further increase a pressure differential between the volume and the interior portion of the or each container so that charging of the or each container is further facilitated.

The present invention provides in a second aspect a method of fabricating at least one container charged with an energetic material, the method comprising charging the or each container using the method according to the first aspect of the present invention and thereafter sealing the or each charged container.

The present invention provides in a third aspect a container charged with an energetic material being fabricated by the method according to the second aspect of the present invention.

The present invention provides in a fourth aspect an apparatus for charging at least one container with an energetic material, the apparatus comprising:

a receptacle having at least one opening and being arranged to receive the or each container, a closure for closing the or each opening of the receptacle, and a vacuum pump for evacuating an interior portion of the receptacle, wherein the apparatus is arranged so that, when the receptacle is opened after the receptacle has been evacuated, a resultant suction charges the or each container with the energetic material.

The receptacle typically is arranged so that a plurality of the containers, such as more than ten or more than one hundred containers can be positioned in the interior of the receptacle. Each container typically is a tube such as a tube composed of a plastics material which may have a diameter in the range of 6 to 100 mm.

The apparatus typically is arranged so that gravity facilitates charging of the containers. The apparatus may also comprise a guiding portion having at least one aperture arranged for positioning adjacent a respective opening of the or each container so that the energetic material is guided into the or each opening when the or each container is charged with the energetic material.

Further, the apparatus may comprise a vibrating portion which is arranged to vibrate the or each container in the receptacle and thereby facilitates dense packaging of the energetic material in the or each container.

In one specific embodiment the receptacle is pivotably connected to a loading container, such as a hopper, which is arranged for loading the energetic material. In this embodiment the receptacle is moveable between a horizontal position and a vertical position. The loading container has in this case a bottom portion which comprises an opening and a closure for closing the opening such as a shutter. The apparatus is arranged so that, when the receptacle is moved from the horizontal position to the vertical position, the bottom portion of the loading container moves over a upper portion of the receptacle, such as an upper opening of the receptacle. If the upper opening is closed, the receptacle may be evacuated. The or each container may be charged with the energetic material by opening a pathway through the upper opening of the receptacle and through the bottom portion of the loading container so that the energetic material is exposed to a suction directed towards the interior of the or each container.

The invention will be more fully understood from the following description of specific embodiments of the invention. The description is provided with reference to the accompanying drawings.

DETAILED DESCRIPTION OF A SPECIFIC EMBODIMENT

Figure 1:
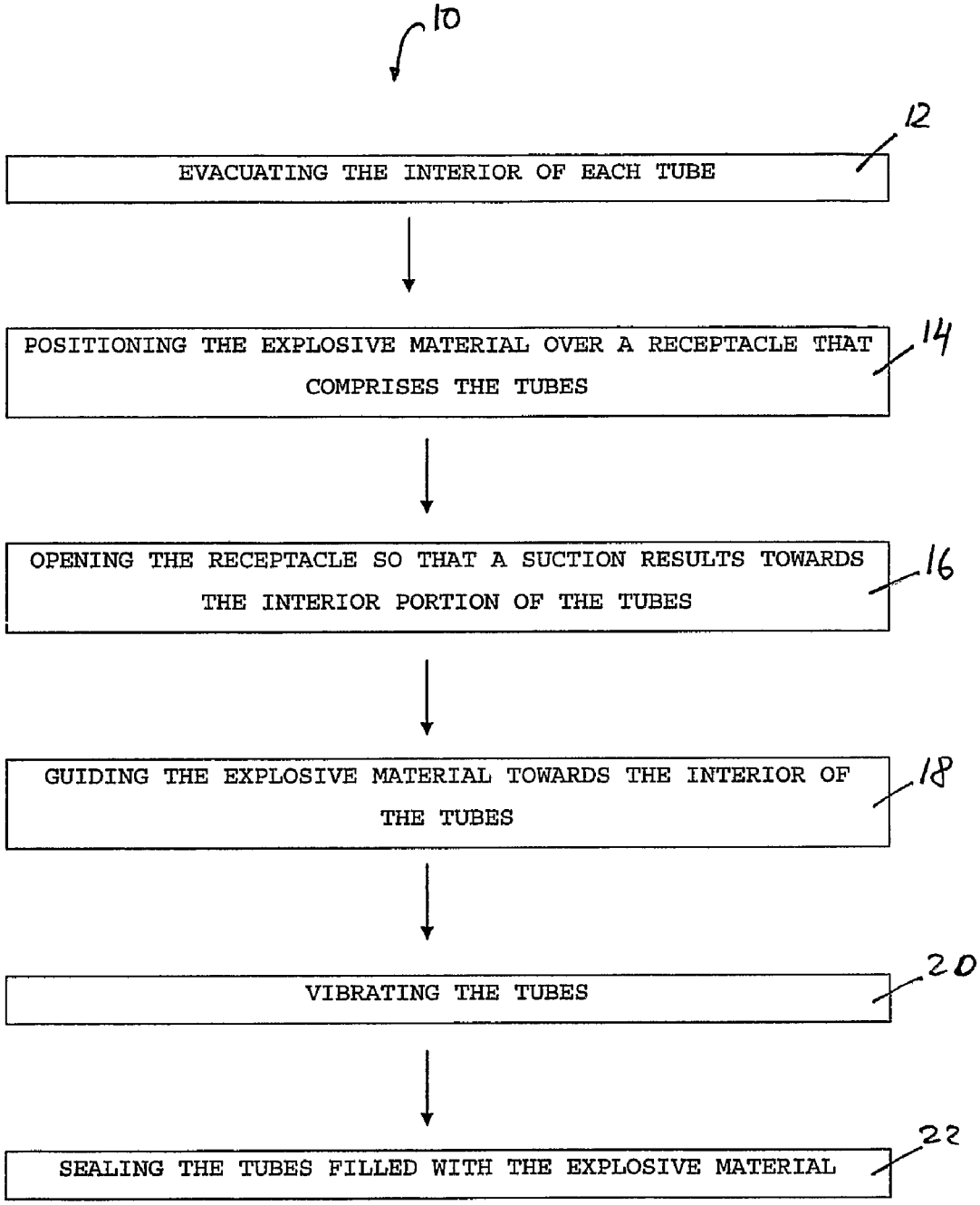
FIG. 1 shows a flow chart illustrating a method of charging at least one container with an energetic material according to an embodiment of the present invention.
Figure 2:
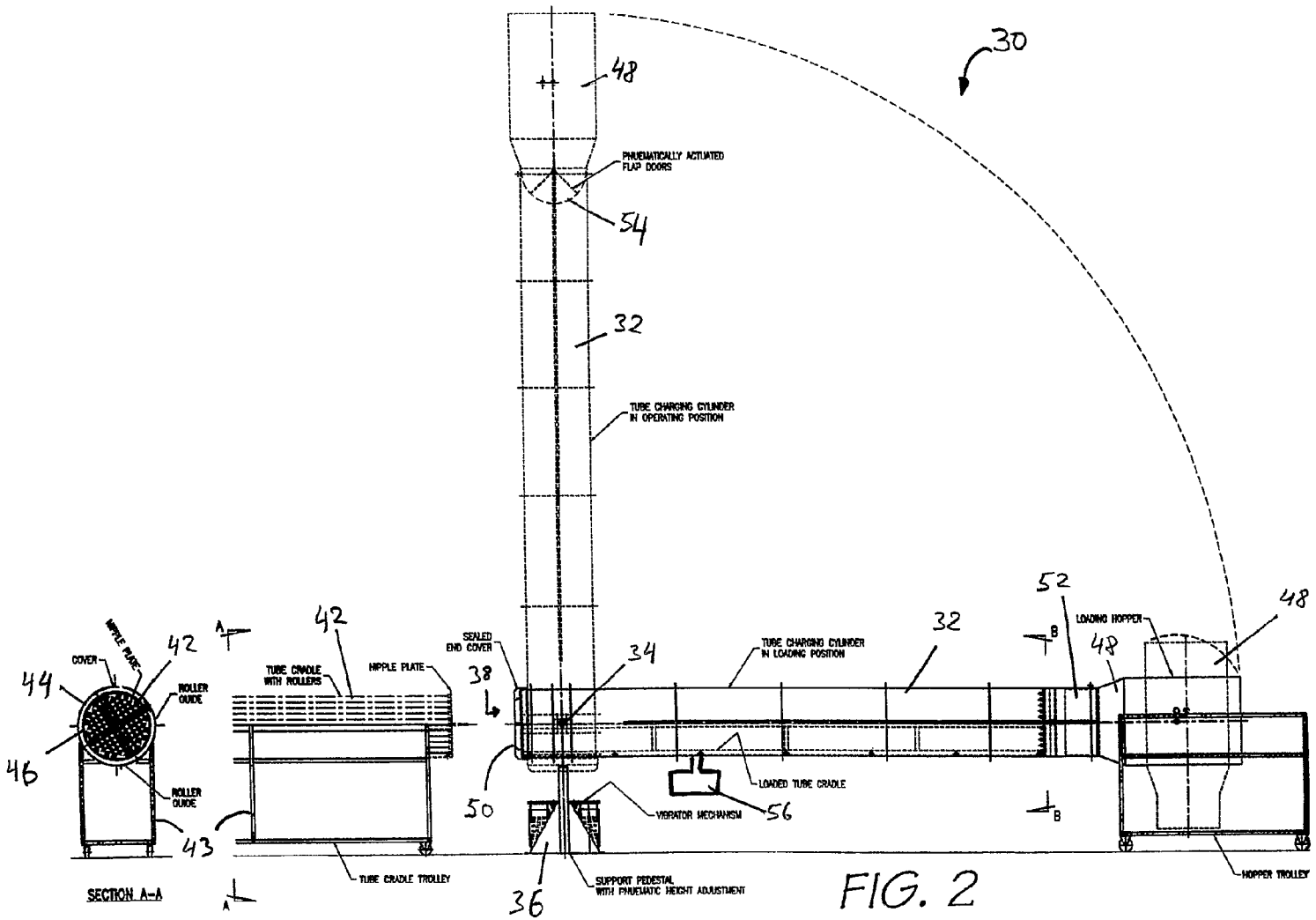
FIG. 2 shows an apparatus for charging at least one container with an energetic material according to a specific embodiment of the present invention

Referring to FIGS. 1 and 2, a method of charging at least one container with an energetic material and an apparatus for charging at least one container with the energetic material is now described.

In brief the method 10 as illustrated in FIG. 1 and according the this specific embodiment comprises the step 12 of evacuating the interior of containers in the form of tubes and step 14 of positioning the energetic material over a receptacle that is loaded with the tubes. The method 10 also comprises the step 16 of opening the receptacle so that a suction results towards the interior portion of the tubes. Step 18 guides the energetic material towards the interior portion of the tubes, step 20 of vibrating the tubes and step 22 of sealing the tubes filled with the energetic material.

In this example the energetic material is a powder or granules of ammonium nitrate and carbon. It is, however, to be appreciated that in variations of this embodiment the energetic material may also be a liquid such as emulsions or water-gels.

FIG. 2 shows an apparatus 30 for performing the method illustrated in FIG. 1 and comprises a receptacle 32 that in this example is elongated and pivotably connected by pivot 34 to a support portion 36. In this example the receptacle 32 is pivotable about pivot 34 between a horizontal position and a vertical position.

The receptacle 32 has an opening 38 and a closure 50 for the opening 38. The receptacle 32 is arranged to receive a plurality of tubes 42. In this example the tubes 42 are composed of a plastics material and typically have an outer diameter of approximately 18 to 32 mm. For loading of the tubes 42 into the receptacle 32 the tubes 42 are positioned in a loading cradle 44 on a trolley 43. Each tube 42 has in this example a closed end and an opposite open end.

The apparatus 30 also comprises a guide which is in this example provided in the form of a plate such as a "nipple plate" 46 comprising a plurality of projections with apertures. The "nipple plate" 46 is positioned at the open end portions of the tubes 42 and arranged so that each aperture is positioned around a respective open end portion of the tubes 42. The loading cradle 44 carrying the tubes 42 is then inserted with the "nipple plate" 46 through the opening 38 into the interior of the receptacle 32. The opening 38 of the receptacle 32 is then closed by closure 40.

In this embodiment the apparatus 30 also comprises a loading hopper 48 which is hingedly connected to the receptacle 32. The loading hopper 48 is arranged to receive the energetic material. The loading hopper 48 has a bottom portion 50 which can be opened by a shutter (not shown).

The receptacle 32 also has an opening 52 which opposes the opening 38 and which can be closed by automatically activated flap doors 54. Once the tubes 42 are loaded in the receptacle 32, the opening 38 is closed with the closure 50 and the automatically activated flap doors 54 are also closed, the receptacle 32 is pivoted about pivot 34 from a horizontal position to a vertical position and the bottom portion 50 of the hopper 48 moves over the automatically activated flap doors 54. The interior portion of the receptacle 42, and thereby the interior portion of each tube 52, is then evacuated using a vacuum pump 56.

Once the interior of the receptacle 32 has reached a sufficiently low pressure, such as 5 PSA, the vacuum pump 56 is shuttered off from the interior space of the receptacle 32 by a pneumatically activated ball valve (not shown). The automatically activated flap doors 54 and the opening 50 of the hopper 48 are then opened. Because of the reduced pressure in the interior of the receptacle 32, the energetic material contained in the hopper 48 is sucked into the interior of the receptacle 32. The "nipple plate" 46 guides the energetic material into the opening of the tubes 42 thereby preventing a flow of the energetic material into a space between the tubes 42.

The support 36 also is arranged for vibrating the receptacle 32. Vibrating of the receptacle 32 facilitates dense packing of the energetic material in the tubes 42. After the tubes 42 are filled with the energetic material the tubes 42 are removed from the interior space of the receptacle 32 and their open ends are sealed.

Although the invention has been described with reference to particular examples, it will be appreciated by those skilled in the art that the invention may be embodied in many other forms. For example, it is to be appreciated that the apparatus for charging at least one container with an energetic may be arranged for filling any number of tubes. Further, the energetic material may not necessarily be filled into containers that are of a tubular shape but the containers may have any other suitable shape. In addition, the method may not necessarily comprise evacuating a receptacle such as receptacle 12 but the tubes may be evacuated directly, for example through an open bottom portion. Further, the apparatus may not comprise a loading hopper which is connected to a receptacle and the receptacle may not necessarily be arranged from pivoting from a horizontal position to a vertical position but may be arranged for operation in a stationary horizontal or angular position. Further, the person skilled in the art will appreciate that embodiments of the present invention may also be used in the field of pyrotechnics. In addition, the energetic material may also be pressurized so that a pressure differential between the interior portion of the or each containers and the energetic material positioned for example in a hopper is increased and thereby charging of the or each containers is facilitated.

The invention claimed is:

1. A method of charging containers with an energetic material capable of detonation, the method comprising:

reducing the pressure of a fluid in an interior portion of a receptacle and in the interior portions of a plurality or containers that are positioned within the receptacle;

positioning the energetic material capable of detonation at a position that is exterior to the receptacle and at which a pressure is higher than in the interior portion of the receptacle in a manner such that a suction results which sucks the energetic material into the interior portion of the receptacle;

guiding the energetic material into an opening or each container using a guiding portion positioned adjacent to the opening, the guiding portion comprising a plurality of projections with apertures and being arranged such that a flow of the energetic material into a space between the containers is prevented; and vibrating the receptacle to facilitate charging of the plurality of containers;

wherein each container is charged with the energetic material capable of detonation.

2. The method as claimed in claim 1 wherein the fluid is air.

3. The method as claimed in claim 1 wherein each container is filled with the energetic material.

4. The method as claimed in claim 1 wherein the step of reducing the pressure in the interior portion of the receptacle comprises evacuating the interior portion of the receptacle.

5. The method as claimed in claim 1 wherein charging of the plurality of containers is supported by gravity.

6. The method as claimed in claim 1 wherein the plurality of containers comprise a plurality of tubes.

7. The method as claimed in claim 6 wherein more than ten tubes are positioned in the receptacle.

8. The method as claimed in claim 6 wherein more than one hundred tubes are positioned in the receptacle.

9. The method as claimed in claim 1 comprising the step of opening the receptacle after it has been evacuated so as to allow the energetic material to be sucked into the interior portion of each container positioned in the receptacle.

10. The method as claimed in claim 1 wherein the energetic material is a powder.

11. The method as claimed in claim 1 wherein the energetic material is provided in form of granules.

12. The method as claimed in claim 1 wherein the energetic material is an emulsion.

13. The method as claimed in claim 1 wherein the energetic material is a water gel.

14. The method as claimed in claim 1 wherein the step of positioning the energetic material is followed by increasing a pressure in a volume in which the energetic material is positioned.

15. A method of fabricating at least one container charged with an energetic material, the method comprising charging the or each container using the method as claimed in claim 1.

16. A container charged with an energetic material being fabricated by the method as claimed in claim 15.

17. An apparatus for charging containers with an energetic material capable of detonation, the apparatus comprising:

a receptacle having at least one opening and being arranged to receive a plurality of containers;

a closure for closing the at least one opening of the receptacle;

a vacuum pump for evacuating an interior portion of the receptacle;

a guiding portion having a plurality of projections with apertures arranged for positioning adjacent a respective opening of each container so that energetic material is guided into each opening when the container are charged with the energetic material capable of detonation; and a vibrating portion which is arranged to vibrate the plurality of containers in the receptacle;

wherein the apparatus is arranged so that, when the receptacle is opened after the receptacle has been evacuated, a suction results and charges the containers with the energetic material capable of detonation and the vibration facilitates dense packaging of the energetic material in the containers.

18. The apparatus as claimed in claim 17 wherein the receptacle is arranged so that a plurality of tubes can be positioned in the interior of the receptacle.

19. The apparatus as claimed in claim 17 arranged so that gravity facilitates charging of the containers.

20. The apparatus as claimed in claim 17 wherein the receptacle is pivotably connected to a loading container which is arranged for loading the energetic material.

21. The apparatus as claimed in claim 20 wherein the receptacle is moveable between a horizontal position and a vertical position.

22. The apparatus as claimed in claim 21 wherein the loading container has a bottom portion which comprises an opening and a closure for the opening and the apparatus is arranged so that, when the receptacle is moved from the horizontal position to the vertical position, the bottom portion of the loading container moves over an upper portion of the receptacle.

23. The method as claimed in claim 1, wherein the energetic material capable of detonation comprises an explosive material.

24. The apparatus as claimed in claim 17, wherein the energetic material capable of detonation comprises an explosive material.

* * * * *

UNITED STATES PATENT AND TRADEMARK OFFICE

CERTIFICATE OF CORRECTION

PATENT NO. : 7,565,857 B2
APPLICATION NO. : 11/547620
DATED : July 28, 2009
INVENTOR(S) : Richard John Johnson It is certified that error appears in the above-identified patent and that said Letters Patent is hereby corrected as shown below:

Column 5, line 21, “or” should read --of--; and

Column 6, line 25, “container” should read --containers--.

Signed and Sealed this
Third Day of April, 2012

David J. Kappos

David J. Kappos
*Director of the United States Patent and Trademark Office*